US007052155B2

(12) United States Patent
Gavin et al.

(10) Patent No.: US 7,052,155 B2
(45) Date of Patent: May 30, 2006

(54) ILLUMINATED MAGNETIC RETRIEVAL APPARATUS

(76) Inventors: Lawrence E. Gavin, 1672 Maple Creek Ct., Rochester, MI (US) 48306; William A. Sampson, 1678 Maple Creek Ct., Rochester, MI (US) 48306

( * ) Notice: Subject to any disclaimer, the term of this patent is extended or adjusted under 35 U.S.C. 154(b) by 116 days.

(21) Appl. No.: 10/641,175

(22) Filed: Aug. 14, 2003

(65) Prior Publication Data

US 2005/0036309 A1 Feb. 17, 2005

(51) Int. Cl.
*B25B 23/18* (2006.01)

(52) U.S. Cl. ..... 362/120; 362/119; 362/198; 362/253; 294/65.5; 335/285

(58) Field of Classification Search ..... 362/109, 362/119–120, 197–199, 253; 294/65.5; 335/285

See application file for complete search history.

(56) References Cited

U.S. PATENT DOCUMENTS 1,360,477 A * 11/1920 Wachtel ..... 362/205
1,521,173 A 12/1924 Catching
1,535,618 A 4/1925 Mayer
1,694,564 A * 12/1928 Sisson ..... 362/289
2,124,161 A * 7/1938 Cook et al. ..... 396/141
2,424,064 A * 7/1947 Stegeman ..... 362/577
3,131,690 A 5/1964 Innis et al.
3,582,638 A * 6/1971 Peters ..... 362/577
3,586,424 A * 6/1971 Schenk et al. ..... 351/213
3,875,397 A * 4/1975 Nicholl ..... 362/188
3,924,115 A * 12/1975 Hampton et al. ..... 362/577
4,646,214 A * 2/1987 Mendleski ..... 362/294
4,813,729 A * 3/1989 Speckhart ..... 294/65.5
5,169,193 A * 12/1992 Stelmach ..... 294/65.5
5,172,271 A * 12/1992 Sinclair ..... 359/652
5,193,030 A * 3/1993 Nozaki et al. ..... 359/687
5,261,714 A * 11/1993 Slusar et al. ..... 294/65.5
5,265,887 A * 11/1993 Stelmach ..... 294/65.5
5,303,036 A * 4/1994 McLachlan et al. ..... 356/440
5,369,555 A 11/1994 McKain et al.
5,381,319 A * 1/1995 Shiao ..... 362/120
5,615,920 A * 4/1997 O'Kane et al. ..... 294/65.5
5,647,623 A * 7/1997 Shiao ..... 294/65.5
5,704,674 A * 1/1998 Boozer ..... 294/65.5
5,727,235 A * 3/1998 Ishikawa et al. ..... 396/62
5,951,142 A * 9/1999 Wang et al. ..... 362/109
5,975,712 A * 11/1999 Shiao ..... 362/120
5,999,074 A * 12/1999 Coleman et al. ..... 335/285
6,007,214 A * 12/1999 Shiao ..... 362/120
6,030,087 A * 2/2000 Whittle ..... 362/18
6,092,914 A * 7/2000 Esakoff et al. ..... 362/268

(Continued)

*Primary Examiner*—Stephen Husar
*Assistant Examiner*—Jason Han

(57) ABSTRACT

An illuminated magnetic retrieval apparatus includes an illumination module which includes a handle portion which houses a battery power supply and which houses illumination circuit means powered by the battery power supply. A flexible optical fiber light conveyance is connected to the handle portion for receiving light from the illumination circuit means. The illumination circuit means include an illumination actuation switch and a light source operated by the illumination actuation switch. The handle portion further includes a housing-mounted electrical connector and an electromagnet actuation switch that is electrically connected to the housing-mounted electrical connector. An electromagnetic retrieval module is connected to the illumination module with cap-shaped handle connection means. The electromagnetic retrieval module also includes a flexible tube for jacketing the flexible optical fiber light conveyance. Electrical conductors extend through the flexible tube and are electrically connected to a connector-means-mounted electrical connector and an electromagnet.

8 Claims, 5 Drawing Sheets

U.S. PATENT DOCUMENTS 6,193,386 B1 * 2/2001 Reynolds ..... 362/109
6,263,133 B1 * 7/2001 Hamm ..... 385/33
6,312,138 B1 * 11/2001 Coleman et al. ..... 362/120
6,392,517 B1 * 5/2002 Coleman et al. ..... 335/285
6,565,229 B1 * 5/2003 Bliss ..... 362/198
6,625,350 B1 * 9/2003 Kikuchi et al. ..... 385/33
6,687,434 B1 * 2/2004 Ishikawa ..... 385/34
6,719,442 B1 * 4/2004 Chen ..... 362/328

* cited by examiner

FIG 4
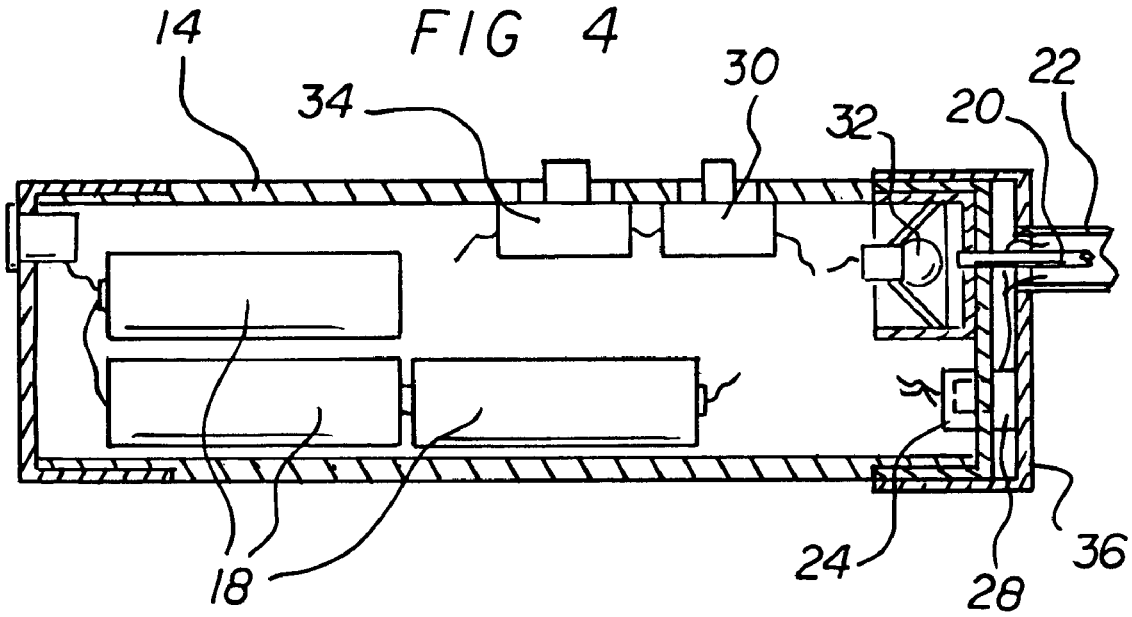
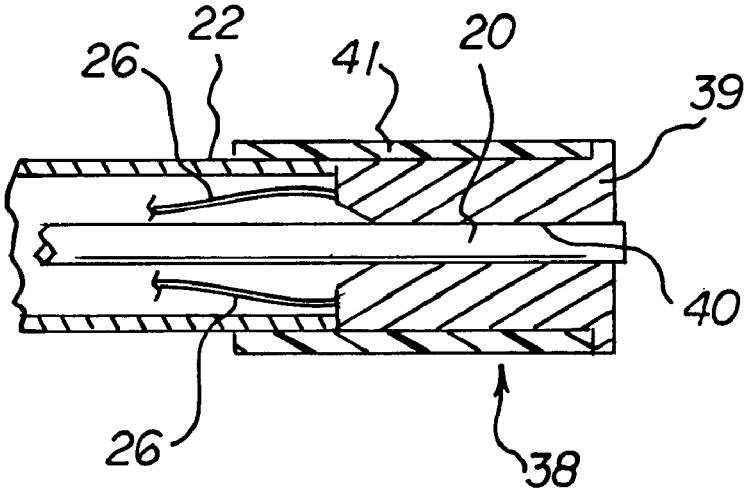
FIG 5

FIG 7
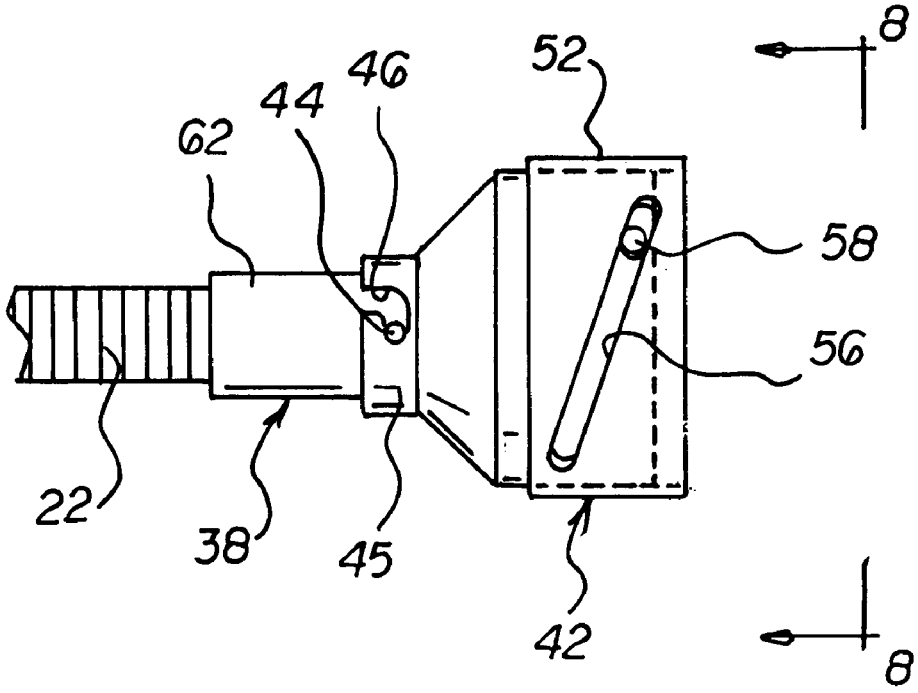
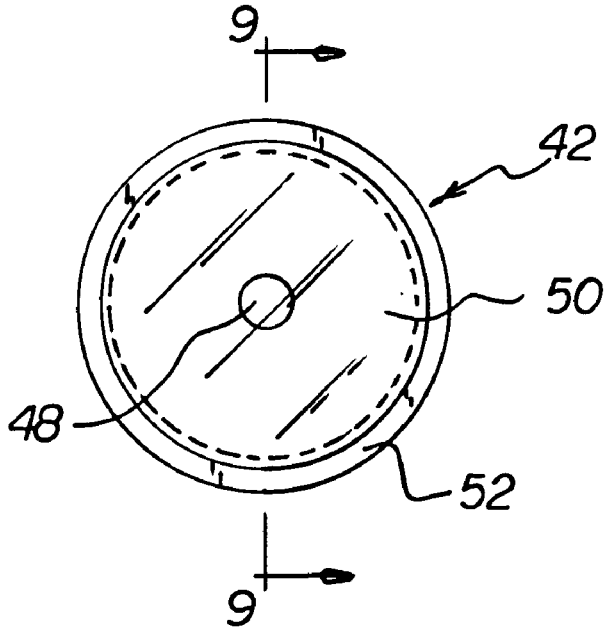
FIG 8

FIG 9
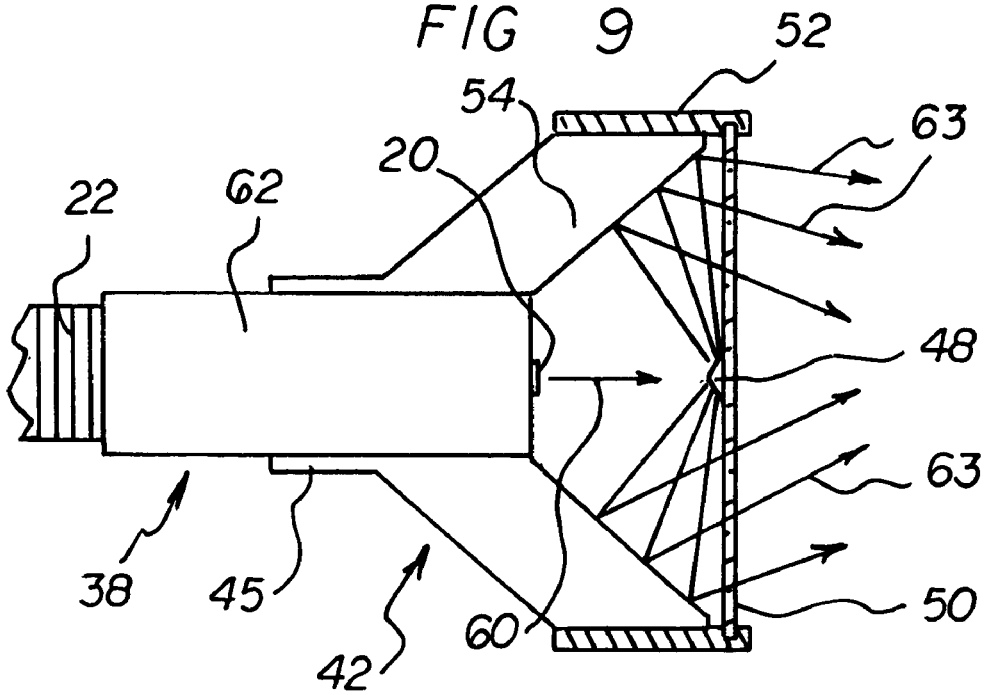
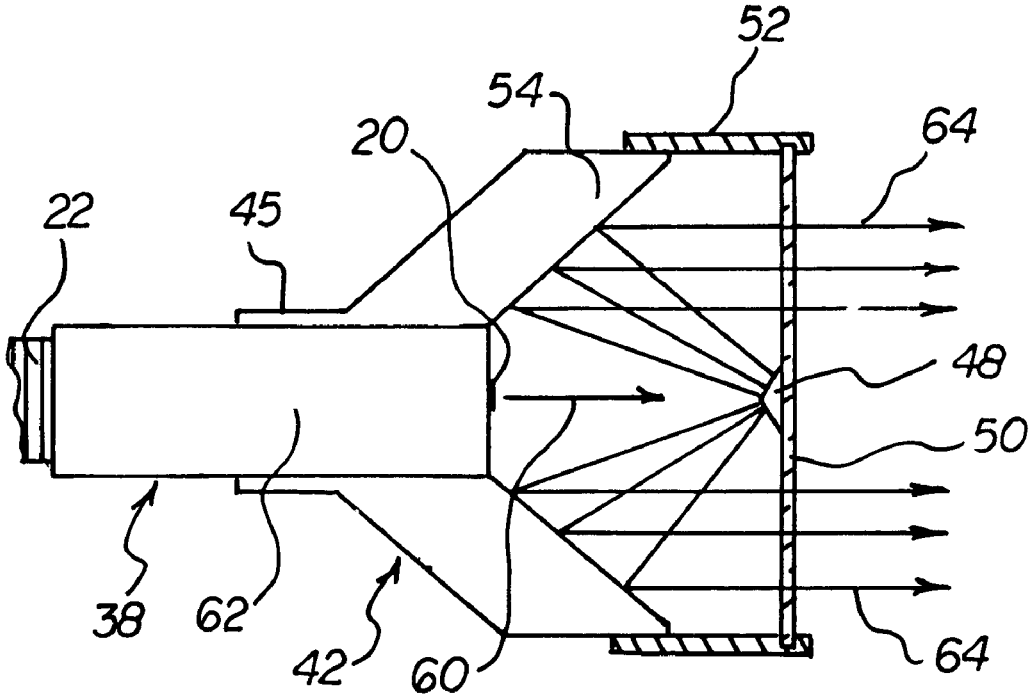
FIG 10

ILLUMINATED MAGNETIC RETRIEVAL APPARATUS

BACKGROUND OF THE INVENTION

1. Field of the Invention

The present invention relates generally to hand-held illuminated inspection devices, and, more particularly, to such hand-held devices especially adapted for retrieving items by magnetic action.

2. Description of the Prior Art

The desire and need to illuminate objects by a hand-held device is well known. It is also well known to use a hand-held device to retrieve items by magnetic action. In this respect, throughout the years, a number of innovations have been developed relating to either illuminating objects by a hand-held device or retrieving items by magnetic action, and the following U.S. patents are representative of some of those innovations: U.S. Pat. Nos. 1,521,173, 1,535,618, 2,424,064, 3,131,690, 3,582,638, 3,924,115, 5,369,555, 5,704,674, 5,951,142, and 6,337,946.

More specifically, each of U.S. Pat. Nos. 1,521,173, 1,535,618, and 5,704,674 discloses a hand-held retrieval device that employs magnetic action. In each patent, a battery-powered electromagnet is employed. It is noted, however, that none of these patents discloses the use of a light to be used in conjunction with a retrieval device that operates with electromagnetic action. In this respect, it would be desirable to provide an electromagnetic retrieval device that also includes a light to be used in conjunction with the magnetic retrieval device.

In addition, each of U.S. Pat. Nos. 2,424,064, 3,131,690, 3,582,638 discloses a hand-held illuminated inspection device. However, none of these devices include a retrieval device.

The following U.S. patents disclose an illuminated magnetic retrieval device: U.S. Pat. Nos. 3,924,115 and 5,951,142. More specifically, U.S. Pat. No. 3,924,115 discloses an electromagnetic pick up tool that has a built in light. It is noted that the electromagnetic components and the illumination components are permanently combined with each other. There may be circumstances, however, when it would be desirable to employ a hand-held illumination device without the encumbrance of a magnetic retrieval device. In this respect, it would be desirable to provide an illuminated magnetic retrieval apparatus from which the magnetic retrieval components can be readily removed from the apparatus.

U.S. Pat. No. 5,951,142 discloses an illuminating, magnetic retrieval device which employs a permanent magnet not an electromagnet. The illuminating components allow an adjustment of the illuminating beam to be varied from divergent to convergent. The light is directed in a direction that is transverse to the main longitudinal axis of the device. However, there are times when it would be desirable to be able to adjust the convergence and divergence of illumination in a direction that is coaxial with the main longitudinal axis of an illuminated magnetic retrieval device. Moreover, it would be desirable to be able to adjust the convergence and divergence of illumination in a direction that is coaxial with the main longitudinal axis of an illuminated electromagnetic retrieval device. Electromagnetic retrieval devices have a benefit over permanent magnet retrieval devices. They enable accurate placement of the retrieval head adjacent to the item to be retrieved, before actuation of the electromagnet, even in the presence of other ferro-magnetic material.

Still other features would be desirable in an illuminated magnetic retrieval apparatus. Adjustment of the convergence and divergence of illumination for an electromagnetic retrieval device may not be necessary or desired all the time. Therefore, it would be desirable to be able to easily add or remove the components for the adjustment of convergence and divergence of illumination. That is, it would be desirable to provide the components for the adjustment of convergence and divergence of illumination in the form of a readily attachable and detachable attachment.

U.S. Pat. No. 5,369,555 may be of interest for its disclosure of an illuminated screwdriver. U.S. Pat. No. 6,337,946 may be of interest for its disclosure of optical light pipes with laser light appearance.

Thus, while the foregoing body of prior art indicates it to be well known to use illuminated magnetic retrieval devices, the prior art described above does not teach or suggest an illuminated magnetic retrieval apparatus which has the following combination of desirable features: (1) provides an electromagnetic retrieval device that also includes a light to be used in conjunction with the magnetic retrieval device; (2) provides an illuminated magnetic retrieval apparatus from which the magnetic retrieval components can be readily removed from the apparatus; (3) enables adjustment of the convergence and divergence of illumination in a direction that is coaxial with the main longitudinal axis of an illuminated magnetic retrieval device; (4) enables adjustment of the convergence and divergence of illumination in a direction that is coaxial with the main longitudinal axis of an illuminated electromagnetic retrieval device; and (5) provides the components for the adjustment of convergence and divergence of illumination in the form of a readily attachable and detachable attachment. The foregoing desired characteristics are provided by the unique illuminated magnetic retrieval apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an illuminated magnetic retrieval apparatus which includes an illumination module which includes a handle portion which houses a battery power supply and which houses illumination circuit means powered by the battery power supply. The illuminated magnetic retrieval apparatus also includes a flexible optical fiber light conveyance connected to the handle portion for receiving light from the illumination circuit means. The illumination circuit means include an illumination actuation switch and a light source operated by the illumination actuation switch. The handle portion further includes a housing-mounted electrical connector and an electromagnet actuation switch that is electrically connected to the housing-mounted electrical connector.

An electromagnetic retrieval module is connected to the illumination module. The electromagnetic retrieval module includes handle connection means for connecting to the handle portion. The electromagnetic retrieval module also includes a flexible tube connected to the handle connection means for jacketing the flexible optical fiber light conveyance. Electrical conductors extend through the flexible tube and are electrically connected to a connector-means-mounted electrical connector. The connector-means-mounted electrical connector is electrically connected to the housing-mounted electrical connector. The electromagnetic retrieval module also includes an electromagnet that is electrically connected to the electrical conductors. The electromagnet includes a light-conveyance-reception channel and is located at a distal end of the flexible tube.

Preferably, the electromagnet includes an electrical winding and core and a jacket which jackets a portion of the electrical winding and core and a distal end of the flexible tube. The electromagnet core includes the light-conveyance-reception channel which receives the distal end of the flexible optical fiber light conveyance.

Preferably, the handle connection means include a cap member for fitting over an end of the handle portion, and the flexible tube is connected to the cap member. Preferably, the cap member is cylindrical in shape, and the end of the handle portion is cylindrical in shape.

With another embodiment of the invention, a light beam adjustment module is provided, and light-adjustment-module connecting means are provided for connecting the light beam adjustment module to a distal end of the electromagnetic retrieval module.

Preferably, the light-adjustment-module connecting means include a lock pin projecting upward from the distal end of the electromagnetic retrieval module, and an attachment sleeve is formed in the light beam adjustment module. The attachment sleeve includes a lock-pin-reception slot for receiving the lock pin for locking the light beam adjustment module to the distal end of the electromagnetic retrieval module.

Preferably, the light beam adjustment module includes a first reflector located along a longitudinal axis which is in registration with a distal end of the flexible optical fiber light conveyance. A lens supports the first reflector. A lens-support member supports the lens. A second reflector receives the lens-support member. The second reflector is supported by the attachment sleeve. The second reflector is arrayed annularly around the longitudinal axis which is in registration with the distal end of the flexible optical fiber light conveyance.

Preferably, the lens-support member further includes a forward/rearward angled adjustment slot, and the second reflector further includes an adjustment pin which is received in the forward/rearward angled adjustment slot. Preferably, the first reflector and the second reflector are conical in shape.

Preferably, the distal end of the electromagnetic retrieval module is cylindrical in shape, and the attachment sleeve is in the form of a cylindrical jacket that fits around the cylindrical distal end of the electromagnetic retrieval module.

Alternatively, a light beam adjustment module, such as described above, can be connected to an illuminated magnetic retrieval apparatus in which electromagnetic retrieval means are permanently connected to the illumination means.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated magnetic retrieval apparatus which has all of the advantages of the prior art and none of the disadvantages.

It is another object of the present invention to provide a new and improved illuminated magnetic retrieval apparatus which may be easily and efficiently manufactured and marketed.

It is a further object of the present invention to provide a new and improved illuminated magnetic retrieval apparatus which is of durable and reliable construction.

An even further object of the present invention is to provide a new and improved illuminated magnetic retrieval apparatus which is susceptible of a low cost of manufacture with regard to both materials and labor, and which accordingly is then susceptible of low prices of sale to the consuming public, thereby making such illuminated magnetic retrieval apparatus available to the buying public.

Still yet a further object of the present invention is to provide a new and improved illuminated magnetic retrieval apparatus which provides an electromagnetic retrieval device that also includes a light to be used in conjunction with the magnetic retrieval device.

Still another object of the present invention is to provide a new and improved illuminated magnetic retrieval apparatus that provides an illuminated magnetic retrieval apparatus from which the magnetic retrieval components can be readily removed from the apparatus.

Yet another object of the present invention is to provide a new and improved illuminated magnetic retrieval apparatus which enables adjustment of the convergence and divergence of illumination in a direction that is coaxial with the main longitudinal axis of an illuminated magnetic retrieval device.

Even another object of the present invention is to provide a new and improved illuminated magnetic retrieval apparatus that enables adjustment of the convergence and divergence of illumination in a direction that is coaxial with the main longitudinal axis of an illuminated electromagnetic retrieval device.

Still a further object of the present invention is to provide a new and improved illuminated magnetic retrieval apparatus which provide the components for the adjustment of convergence and divergence of illumination in the form of a readily attachable and detachable attachment.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 4 is an enlarged cross-sectional view of the embodiment of the invention of FIG. 2, taken along line 4—4 thereof.

FIG. 5 is an enlarged cross-sectional view of the embodiment of the invention of FIG. 3, taken along line 5—5 thereof.

FIG. 7 is a partial side view of a second embodiment of the invention which includes a light convergence/divergence module attached to the distal end of the electromagnetic retrieval module.

FIG. 8 is a front end view of the embodiment of the invention shown in FIG. 7, taken along line 8—8 thereof.

FIG. 9 is an enlarged cross-sectional view of the embodiment shown in FIG. 8, wherein the light convergence/divergence module is adjusted for light convergence.

FIG. 10 is an enlarged cross-sectional view of the embodiment shown in FIG. 8, wherein the light convergence/divergence module is adjusted for parallel light divergence.

DESCRIPTION OF THE PREFERRED EMBODIMENT

Figure 1:
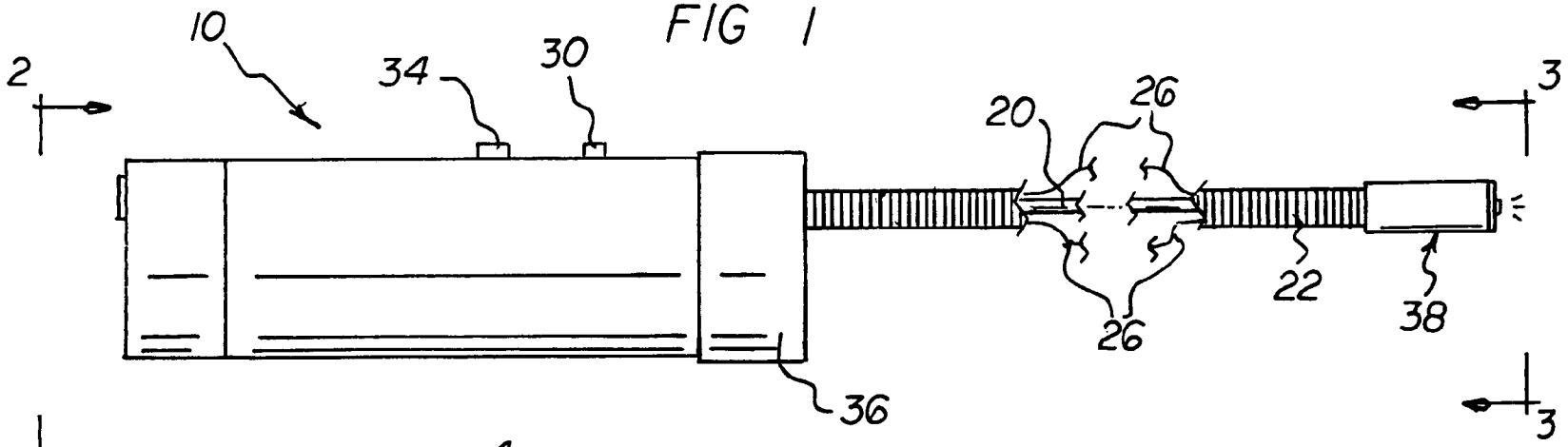
FIG. 1 is a side view showing a first embodiment of the illuminated magnetic retrieval apparatus of the invention in which an electromagnetic retrieval module is attached to the illumination module.
Figure 3:
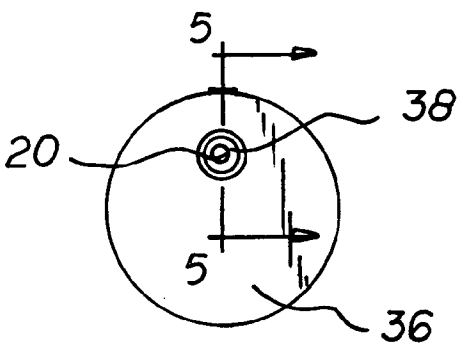
FIG. 3 is a front end view of the embodiment of the illuminated magnetic retrieval apparatus of FIG. 1 taken along line 3—3 thereof.
Figure 2:
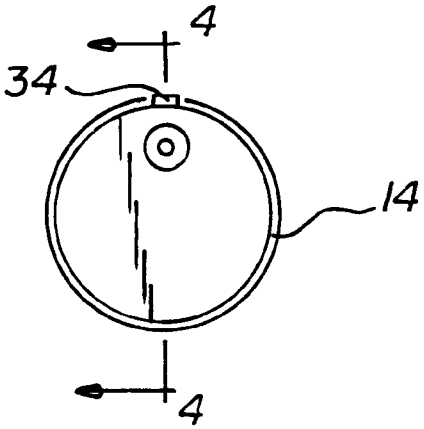
FIG. 2 is a rear end view of the embodiment of the illuminated magnetic retrieval apparatus shown in FIG. 1 taken along line 2—2 of FIG. 1.

With reference to the drawings, a new and improved illuminated magnetic retrieval apparatus embodying the principles and concepts of the present invention will be described.

Turning to FIGS. 1–6, there is shown a first embodiment of the illuminated magnetic retrieval apparatus of the invention generally designated by reference numeral 10. In the first embodiment, illuminated magnetic retrieval apparatus 10 includes an illumination module 12 which includes a handle portion 14 which houses a battery power supply 18 and which houses illumination circuit means powered by the battery power supply 18. The illuminated magnetic retrieval apparatus 10 also includes a flexible optical fiber light conveyance 20 connected to the handle portion 14 for receiving light from the illumination circuit means. The illumination circuit means include an illumination actuation switch 30 and a light source 32 operated by the illumination actuation switch 30. The handle portion 14 further includes a housing-mounted electrical connector 24 and an electromagnet actuation switch 34 that is electrically connected to the housing-mounted electrical connector 24.

An electromagnetic retrieval module 16 is connected to the illumination module 12. The electromagnetic retrieval module 16 includes handle connection means for connecting to the handle portion 14. The electromagnetic retrieval module 16 also includes a flexible tube 22 connected to the handle connection means for jacketing the flexible optical fiber light conveyance 20. Electrical conductors 26 extend through the flexible tube 22 and are electrically connected to a connector-means-mounted electrical connector 28. The connector-means-mounted electrical connector 28 is electrically connected to the housing-mounted electrical connector 24. The electromagnetic retrieval module 16 also includes an electromagnet 38 that is electrically connected to the electrical conductors 26. The electromagnet 38 includes a light-conveyance-reception channel 40 and is located at a distal end of the flexible tube 22.

Preferably, the electromagnet 38 includes an electrical winding and core 39 and a jacket 41 which jackets a portion of the core 39 and a distal end of the flexible tube 22. The electromagnet core 39 includes the light-conveyance-reception channel 40 which receives the distal end of the flexible optical fiber light conveyance 20.

Preferably, the handle connection means include a cap member 36 for fitting over an end of the handle portion 14, and the flexible tube 22 is connected to the cap member 36. Preferably, the cap member 36 is cylindrical in shape, and the end of the handle portion 14 is cylindrical in shape.

As shown in FIG. 1, the electromagnetic retrieval module 16 is fitted onto the illumination module 12. When this is done, the connector-means-mounted electrical connector 28 is electrically connected to the housing-mounted electrical connector 24 so that the electromagnet 38 receives electrical power from the battery power supply 18 through the electromagnet actuation switch 34. Also, the flexible optical fiber light conveyance 20 receives light from the light source 32 when the light source 32 is powered by the battery power supply 18 through the illumination actuation switch 30. The cap member 36 of the electromagnetic retrieval module 16 fits tightly over an end of the handle portion 14 keeping the electromagnetic retrieval module 16 attached to the illumination module 12. The cap member 36 can fit onto the handle portion 14 by means of a friction fit, or other suitable means of connection. Also, the distal end of the flexible optical fiber light conveyance 20 is received in the light-conveyance-reception channel 40 of the core jacket 41 of the electromagnet 38, as shown in FIG. 5.

In use, the illumination actuation switch 30 can be turned to an "on" position before the electromagnet actuation switch 34 is turned to an "on" position. In this way, an operator can readily see how to position the electromagnet 38 near a ferro-magnetic item to be retrieved before actuation of the electromagnet 38. This enables accurate positioning of the electromagnet 38 in the presence of other ferro-magnetic objects before the electromagnet 38 is actuated. Both the flexible optical fiber light conveyance 20 and the flexible tube 22 are flexible and can be bent to fit into hard to get to locations. Once the electromagnet 38 is located adjacent to the ferro-magnetic item to be retrieved, the electromagnet actuation switch 34 is turned to the "on" position, and the electromagnet 38 is energized, causing it to magnetically attract the item to be retrieved.

Figure 6:
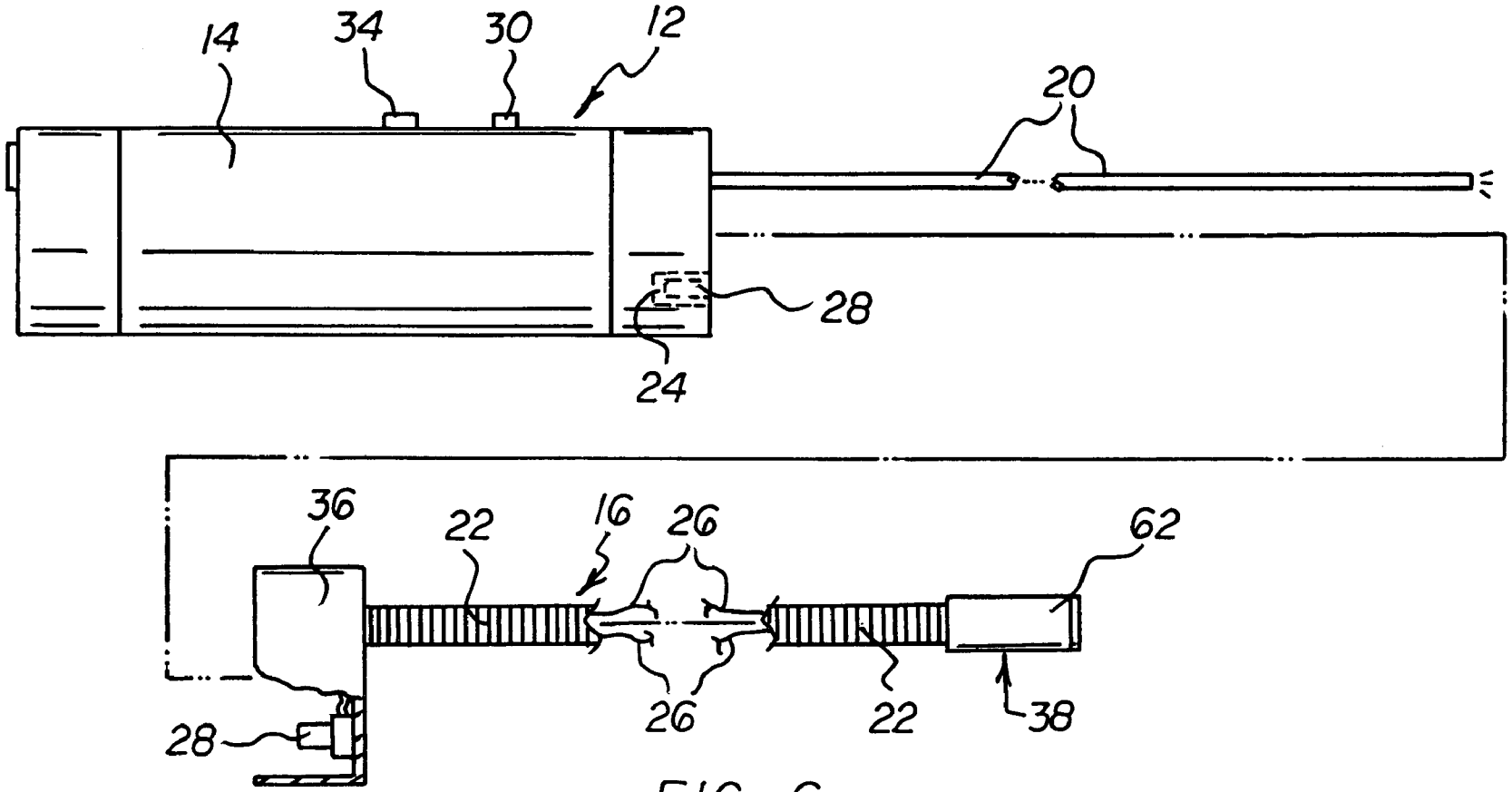
FIG. 6 is partially exploded side view of the embodiment of the invention shown in FIG. 1, wherein the electromagnetic retrieval module is separated from the illumination module.

As shown in FIG. 6, the electromagnetic retrieval module 16 can be readily separated from the illumination module 12. When this is done, the connector-means-mounted electrical connector 28 is disconnected from the housing-mounted electrical connector 24. With the electromagnetic retrieval module 16 off of the illumination module 12, the illumination module 12 can be used simply to perform an illumination function.

Turning to FIGS. 7 to 10, a second embodiment of the invention is shown. Reference numerals are shown that correspond to like reference numerals that designate like elements shown in the other figures. In addition, a light beam adjustment module 42 is provided, and light-adjustment-module connecting means are provided for connecting the light beam adjustment module 42 to a distal end 62 of the electromagnetic retrieval module 16.

Preferably, the light-adjustment-module connecting means include a lock pin 44 projecting upward from the distal end of the electromagnetic retrieval module 16, and an attachment sleeve 45 is formed in the light beam adjustment module 42. The attachment sleeve 45 includes a lock-pin-reception slot 46 for receiving the lock pin 44 for locking the light beam adjustment module 42 to the distal end of the electromagnetic retrieval module 16.

Preferably, the light beam adjustment module 42 includes a first reflector 48 located along a longitudinal axis 60 which is in registration with a distal end of the flexible optical fiber light conveyance 20. A lens 50 supports the first reflector 48. A lens-support member 52 supports the lens 50. A second reflector 54 receives the lens-support member 52. The second reflector 54 is supported by the attachment sleeve 45. The second reflector 54 is arrayed annularly around the longitudinal axis 60 which is in registration with the distal end of the flexible optical fiber light conveyance 20.

Preferably, the lens-support member 52 further includes a forward/rearward angled adjustment slot 56, and the second reflector 54 further includes an adjustment pin 58 which is received in the forward/rearward angled adjustment slot 56. Preferably, the first reflector 48 and the second reflector 54 are conical in shape.

Preferably, the distal end of the electromagnetic retrieval module 16 is cylindrical in shape, and the attachment sleeve 45 is in the form of a cylindrical jacket that fits around the cylindrical distal end of the electromagnetic retrieval module 16.

Alternatively, a light beam adjustment module 42, such as described above, can be connected to an illuminated magnetic retrieval apparatus 10 in which electromagnetic retrieval means are permanently connected to the illumination means.

Preferably, the light beam adjustment module 42 is used with the embodiment of the invention illustrated in FIGS. 1–6. More specifically, the attachment sleeve 45 is fitted onto the distal end of the electromagnet 38 so that the lock pin 44 is engaged with the locking portion of the lock-pin-reception slot 46, as shown in FIG. 7.

The light convergence/divergence of light emerging from the lens 50 of the light beam adjustment module 42 is controlled by adjustment of the positioning of the first conical reflector 48 with respect to the second conical reflector 54. The first conical reflector 48 provides an essentially convex reflective surface to the second conical reflector 54 which provides an essentially concave reflective surface.

When the lens-support member 52 is rotated in a first direction around the longitudinal axis 60, the adjustment pin 58 rides in the forward/rearward angled adjustment slot 56 to move the first conical reflector 48 toward the second conical reflector 54. When this is done, as shown in FIG. 9, the light beams 63 emerging through the lens 50 converge toward each other, and then diverge as they pass a focal point, projecting in a direction coaxial to the longitudinal axis 60.

In contrast, when the lens-support member 52 is rotated in a second direction around the longitudinal axis 60, which is opposite to the first direction of rotation, the adjustment pin 58 rides in the forward/rearward angled adjustment slot 56 to move the first conical reflector 48 away from the second conical reflector 54. When this is done, as shown in FIG. 10, the light beams 64 emerging through the lens 50 project in a direction coaxial to the longitudinal axis 60 and project parallel to the longitudinal axis 60.

Therefore, simply by rotating the lens-support member 52 around the longitudinal axis 60, the convergence or divergence of the light beams emerging from the light beam adjustment module 42 through the lens 50 can be controlled.

The components of the illuminated magnetic retrieval apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved illuminated magnetic retrieval apparatus that is low in cost, relatively simple in design and operation, and which may advantageously be used to provide an electromagnetic retrieval device that also includes a light to be used in conjunction with the electromagnetic retrieval device. With the invention, an illuminated magnetic retrieval apparatus provides an illuminated magnetic retrieval apparatus from which the magnetic retrieval components can be readily removed from the apparatus. With the invention, an illuminated magnetic retrieval apparatus is provided which enables adjustment of the convergence and divergence of illumination in a direction that is coaxial with the main longitudinal axis of an illuminated magnetic retrieval device. With the invention, an illuminated magnetic retrieval apparatus is provided which enables adjustment of the convergence and divergence of illumination in a direction that is coaxial with the main longitudinal axis of an illuminated electromagnetic retrieval device. With the invention, an illuminated magnetic retrieval apparatus is provided which provide the components for the adjustment of convergence and divergence of illumination in the form of a readily attachable and detachable attachment.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An illuminated magnetic retrieval apparatus, comprising:

an illumination module which includes a handle portion which houses a battery power supply and which houses illumination circuit means powered by said battery power supply, which includes a flexible optical fiber light conveyance connected to said handle portion for receiving light from said illumination circuit means, wherein said illumination circuit means include an illumination actuation switch and a light source operated by said illumination actuation switch, and wherein said handle portion further includes a housing-mounted electrical connector and an electromagnet actuation switch electrically connected to said housing-mounted electrical connector, an electromagnetic retrieval module connected to said illumination module, wherein said electromagnetic retrieval module includes handle connection means for connecting to said handle portion, includes a flexible tube connected to said handle connection means for jacketing said flexible optical fiber light conveyance, includes electrical conductors extending through said flexible tube and electrically connected to a connector-means-mounted electrical connector, wherein said connector-means-mounted electrical connector is electrically connected to said housing-mounted electrical connector, and includes an electromagnet electrically connected to said electrical conductors, wherein said electromagnet includes a light-conveyance-reception channel and is located at a distal end of said flexible tube, said apparatus further including:

a light beam adjustment module, and light-adjustment-module connecting means for connecting said light beam adjustment module to a distal end of said electromagnetic retrieval module, wherein said light-adjustment-module connecting means include:

a lock pin projecting upward from said distal end of said electromagnetic retrieval module, and an attachment sleeve formed in said light beam adjustment module, wherein said attachment sleeve includes a lock-pin-reception slot for receiving said lock pin for locking said light beam adjustment module to said distal end of said electromagnetic retrieval module, and wherein said light beam adjustment module includes:

a first reflector located along a longitudinal axis which is in registration with a distal end of said flexible optical fiber light conveyance, a lens which supports said first reflector, a lens-support member which supports said lens, and a second reflector which receives said lens-support member, wherein said second reflector is supported by said attachment sleeve.

2. The apparatus of claim 1 wherein said electromagnet includes an electromagnetic core and a jacket which jackets a portion of said electromagnetic core and a distal end of said flexible tube.

3. The apparatus of claim 1 wherein:

said handle connection means include a cap member for fitting over an end of said handle portion, and said flexible tube is connected to said cap member.

4. The apparatus of claim 3 wherein:

said cap member is cylindrical in shape, and said end of said handle portion is cylindrical in shape.

5. The apparatus of claim 1 wherein:

said distal end of said electromagnetic retrieval module is cylindrical in shape, and said attachment sleeve is in the form of a cylindrical jacket that fits around said cylindrical distal end of said electromagnetic retrieval module.

6. The apparatus of claim 1 wherein said second reflector is arrayed annularly around said longitudinal axis which is in registration with said distal end of said flexible optical fiber light conveyance.

7. The apparatus of claim 1 wherein:

said lens-support member further includes a forward/rearward angled adjustment slot, and said second reflector further includes an adjustment pin which is received in said forward/rearward angled adjustment slot.

8. The apparatus of claim 1 wherein said first reflector and said second reflector are conical in shape.

* * * * *